US006976330B2

(12) United States Patent
Milliken

(10) Patent No.: US 6,976,330 B2
(45) Date of Patent: Dec. 20, 2005

(54) HINGE ASSEMBLY FOR SIGN BOX FACE

(75) Inventor: K. Blair Milliken, Englewood, FL (US)

(73) Assignee: Milliken & Milliken, Englewood, FL (US)

( * ) Notice: Subject to any disclaimer, the term of this patent is extended or adjusted under 35 U.S.C. 154(b) by 0 days.

(21) Appl. No.: 10/406,615

(22) Filed: Apr. 3, 2003

(65) Prior Publication Data

US 2004/0035032 A1 Feb. 26, 2004

Related U.S. Application Data

(60) Provisional application No. 60/369,747, filed on Apr. 4, 2002.

(51) Int. Cl.[7] ..... G09F 13/04
(52) U.S. Cl. ..... 40/574; 40/564
(58) Field of Search ..... 40/574, 564, 590, 40/791, 782; 52/730.4, 730.5, 730.6, 731.2, 52/731.7; D25/119–126

(56) References Cited

U.S. PATENT DOCUMENTS

| | | | | |
|---|---|---|---|---|
| 1,895,309 A | | 1/1933 | Boomershine | |
| 4,092,992 A | | 6/1978 | Huddle | |
| 4,189,880 A | | 2/1980 | Ballin | |
| 4,265,039 A | | 5/1981 | Brooks | |
| 4,267,657 A | * | 5/1981 | Kloke | 40/549 |
| 4,317,302 A | | 3/1982 | Von De Linde | |
| 4,452,000 A | | 6/1984 | Gandy | |
| 4,542,605 A | | 9/1985 | Gandy | |
| 4,547,987 A | * | 10/1985 | Stilling | 40/574 |
| D290,172 S | * | 6/1987 | Hardy | D25/122 |
| 4,771,559 A | | 9/1988 | Keithley | |
| 4,799,299 A | | 1/1989 | Campbell | |
| 4,817,317 A | | 4/1989 | Kovalak, Jr. | |
| 4,817,655 A | | 4/1989 | Brooks | |
| 4,833,805 A | | 5/1989 | Roberson | |
| 4,926,605 A | | 5/1990 | Milliken et al. | |
| 5,020,254 A | | 6/1991 | Sheppard | |
| 5,207,262 A | | 5/1993 | Ruthford | |
| 5,224,306 A | | 7/1993 | Cramer | |
| D338,537 S | * | 8/1993 | Westphal et al. | D25/122 |
| 5,242,004 A | | 9/1993 | Stilling | |
| 5,333,425 A | | 8/1994 | Nickerson et al. | |
| 5,380,120 A | | 1/1995 | Vermeulen | |
| 5,398,436 A | | 3/1995 | Suzuki | |
| 5,469,672 A | | 11/1995 | Fisher | |
| 5,515,629 A | * | 5/1996 | Johansson | 40/745 |

(Continued)

*Primary Examiner*—Cassandra Davis
(74) *Attorney, Agent, or Firm*—Donald R. Piper, Jr.; Dann, Dorfman, Herrell & Skillman, PC

(57) ABSTRACT

A hinged sign face assembly is provided for use on a standard sign box. The assembly may be retrofitted on an existing sign box to facilitate access to fluorescent light tubes and other components inside the sign box. The assembly pivots the face of a sign box to an open position to allow interior components to be accessed without the need for disassembling the sign box frame. The assembly includes a hinge adapter that mounts to a standard sign box. The hinge adapter is operable with commercially available components to convert a rigid standard sign box to a hinged sign box. The assembly may also include a hinge connector secured with the sign face that may be connected to the adapter in a hinged manner without fasteners. The hinge connector supports the sign face and cooperates with the adapter to allow the sign face to pivot on the sign box.

27 Claims, 4 Drawing Sheets

U.S. PATENT DOCUMENTS

| | | | |
|---|---|---|---|
| 5,566,483 | A | 10/1996 | Ogren |
| 5,588,236 | A | 12/1996 | Suzuki |
| 5,647,176 | A | 7/1997 | Milliken et al. |
| 5,665,938 | A | 9/1997 | Boshear et al. |
| 5,794,400 | A | 8/1998 | Fisher et al. |
| 5,893,227 | A | 4/1999 | Johansson et al. |
| 5,896,718 | A | 4/1999 | Westgarth |
| 5,899,027 | A | 5/1999 | St. Louis |
| 6,070,351 | A | 6/2000 | Verret |
| 6,073,376 | A | 6/2000 | Verret |
| 6,076,328 | A | 6/2000 | Danhof et al. |
| 6,088,942 | A | 7/2000 | Brooks et al. |
| 6,112,444 | A | 9/2000 | Milliken et al. |
| D434,084 | S | 11/2000 | LaFountain et al. |
| 6,263,949 | B1 | 7/2001 | Guthrie, Jr. |
| 6,368,011 | B1 | 4/2002 | LaFountain et al. |
| 6,412,250 | B2 | 7/2002 | Davis |

* cited by examiner

HINGE ASSEMBLY FOR SIGN BOX FACE

RELATED APPLICATIONS

This application claims priority from U.S. Provisional Application No. 60/369,747, filed Apr. 4, 2002, the entire disclosure of which is incorporated herein by reference.

FIELD OF THE INVENTION

The present invention relates generally to extrusion members used in the construction of sign and display assemblies and, more particularly, to an assembly for adding a hinged face to a sign or display cabinet.

BACKGROUND

In the present state of the art, illuminated signs are commonly constructed using rectangular sign boxes or cabinets. A sign box typically encloses a light source, such as a row of flourescent light tubes, that is mounted within the sign box. The sign box has one or more faces formed of translucent sheets that are mounted over the light source. Each face may be painted or marked with text or a design that is illuminated by the light source inside the sign box.

Sign boxes provide a weatherproof housing for the fluorescent light tubes, ballasts, wiring and other components in the sign. In many cases, the sign box is constructed using a framework of aluminum extrusions which form frame members and mounting components. The frame members and sign faces must be rigidly connected with one another to support the weight of the sign and withstand external forces, such as gale winds. At the same time, the frame members must allow access to the internal components of the sign so that the internal components can be serviced.

In many standard sign boxes, sign faces are bolted to the sign box frame. To service internal components in the sign box, the sign faces are disassembled from the frame to enable access to the sign box interior. Disassembly of a sign face requires effort and increases the overall time required to perform routine service on a sign installation. Accordingly, it is beneficial to provide an assembly for sign boxes to permit access to the interior of the sign box without requiring disassembly of the frame structure for the sign. One approach to solving this problem has been the use of sign boxes that have sign faces mounted to the frame on a piano hinge. Piano hinges allow a sign face to be pivoted to an open position without disassembling the frame. However, the piano hinge has been conventionally attached to both the frame and the sign face making complete removal of the sign face from the frame difficult. While it is nice to have a sign face that swings open, in certain applications, it would be even more desirable to have a sign face that has both the capability to be swung open and the capability to be easily detached from the frame. In still other applications, replacing the piano hinge for a more simplified hinge assembly creates a more cost effective design.

SUMMARY OF THE INVENTION

In light of the foregoing, the present invention provides a hinge assembly for enabling a sign face to be hinged to a sign box frame. The hinge assembly may be retrofitted to an existing sign box installation. Alternatively, the hinge assembly may be manufactured and sold as part of a new sign box installation. The hinge assembly allows a standard sign box to be opened and closed, permitting easy access to internal components in the sign box. In one embodiment of the invention, the components of the assembly may be mounted over the front face of a sign box to permit the front face to be pivoted open and closed.

The hinge assembly may include one or more components for mounting on a new or existing sign box. For example, an adapter may be provided to enable a sign face or a sign face assembly to be mounted on a sign box frame in a hinged manner. The hinged sign face may be mounted onto the adapter without the need for special tools or additional fasteners. The adapter may be formed from various materials and have different shapes for attachment to a sign box frame. For example, the adapter may be formed of an aluminum extrusion and include a main body portion configured for attachment to a sign box frame. A fulcrum may be provided on the adapter for supporting the sign face. Alternatively, a receptacle may extend from the main body portion of the adapter over a side of the sign box to allow for the hinged connection of a sign face assembly on the sign box. The receptacle may be configured in the form of a slotted box having a receptacle slot to serve as a hinge receptacle. The hinge assembly may also include a hinge connector on a sign face or a sign face assembly that is mountable on the adapter in a hinged manner without the need for tools or fasteners. The hinge connector may include a hinge tongue that is configured to be supported on the fulcrum or inserted within the receptacle slot of the adapter to form a hinge. The hinge connector may be attached to various types of sign faces or sign face assemblies for hinged mounting on the adapter. For example, the hinge connector may be attached to a rigid sign face material, a flexible sign face material, or a support assembly for such face materials for attachment to the sign box.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
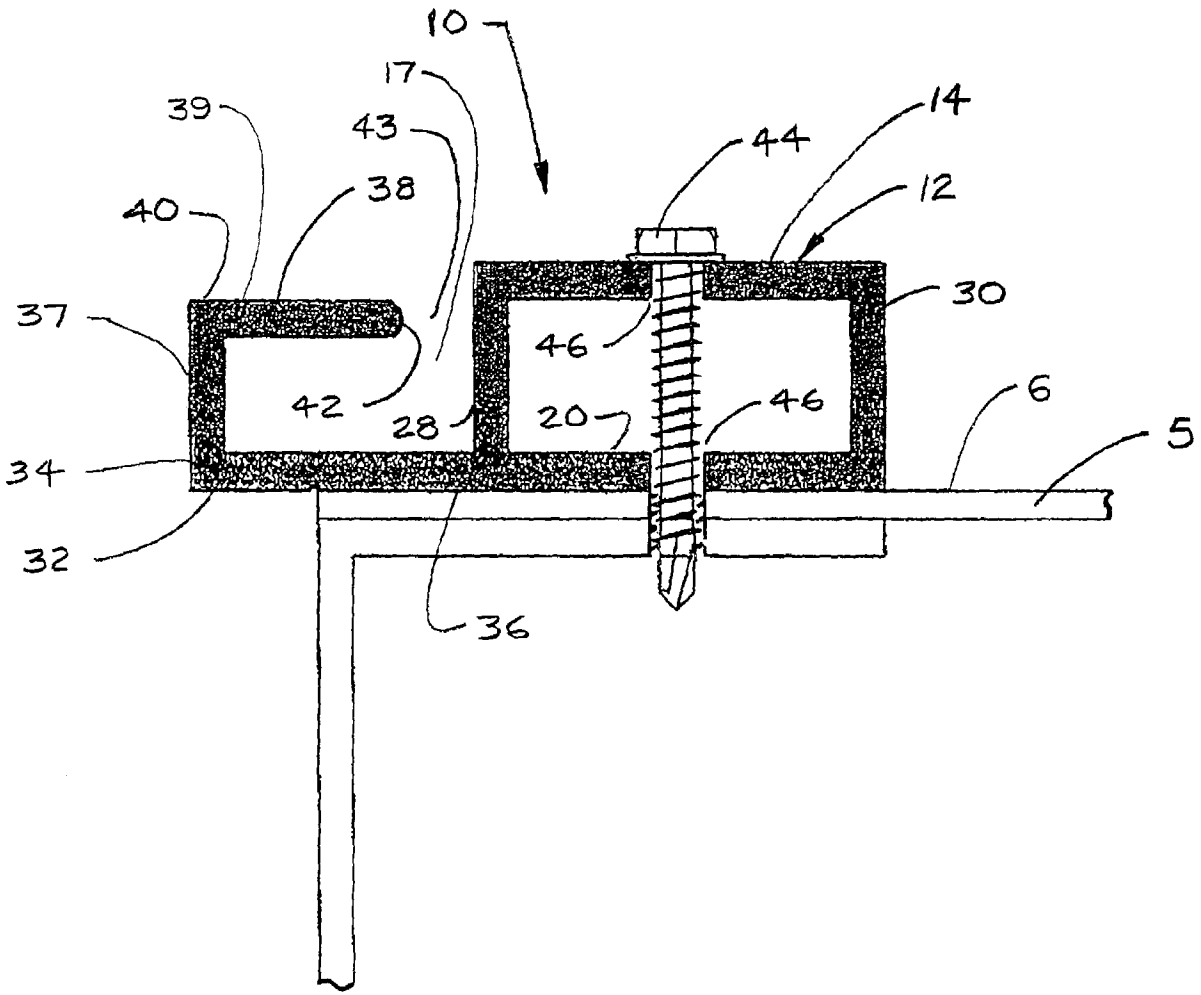
FIG. 1 is a fragmented cross-sectional elevation view of a hinge adapter mounted on a sign box in accordance with the present invention.
Figure 2:
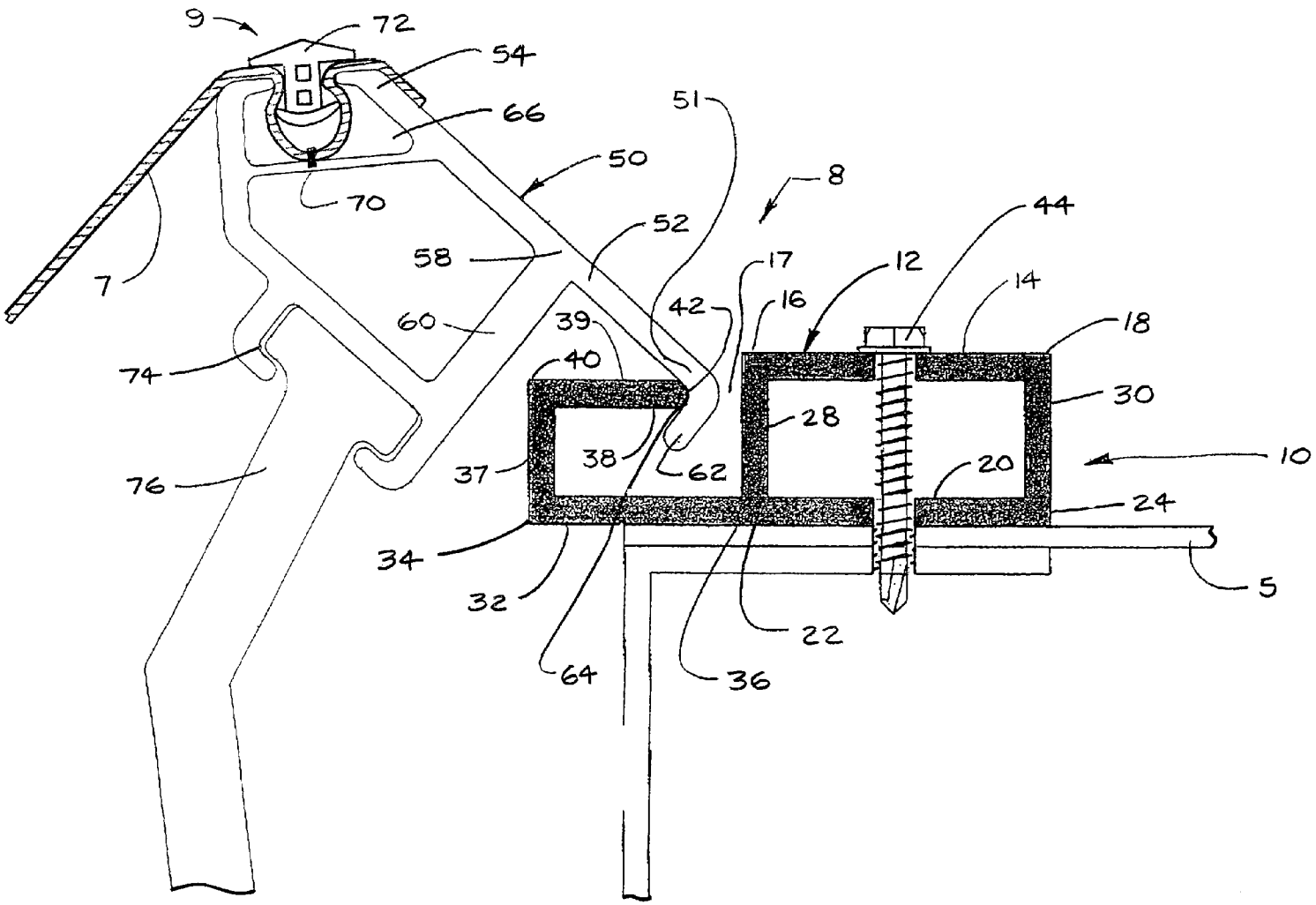
FIG. 2 is a fragmented cross-sectional elevation view of a hinged sign face assembly in accordance with the present invention, showing the hinge adapter and a sign face assembly hinged to the adapter and pivoted to an open position on a sign box.
Figure 3:
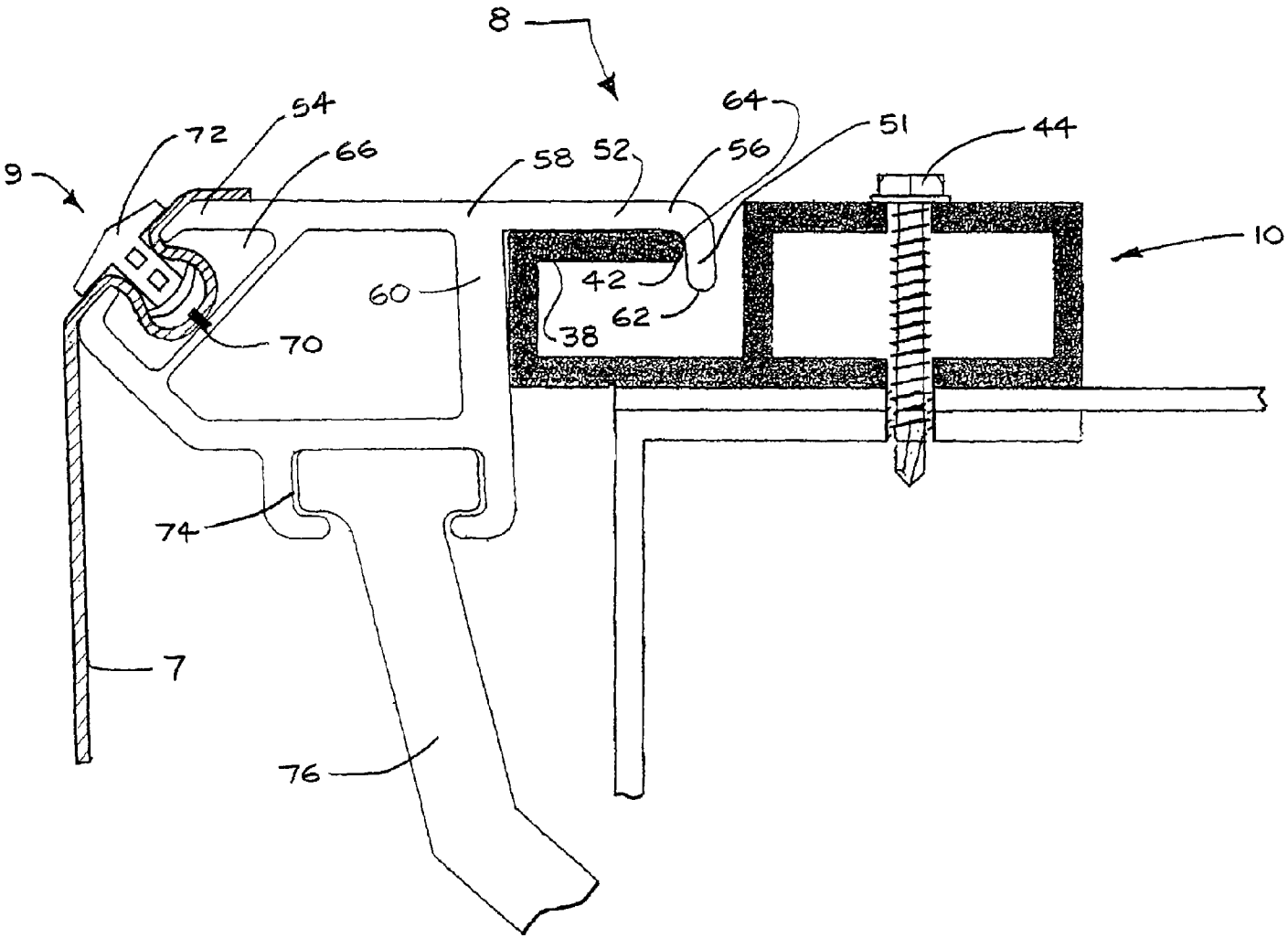
FIG. 3 is a fragmented cross-sectional elevation view of the hinged sign face assembly of FIG. 2, showing the hinge adapter and the sign face assembly pivoted to a closed position on the sign box.

Referring to FIGS. 1–4 in general, and to FIGS. 1–2 specifically, a hinge adapter, generally designated 10, for use in a hinged sign face assembly is shown. The adapter 10 is configured to be mounted on the top surface 6 of a standard sign box 5. The adapter 10 is mountable along a top edge 6 of the sign box 5 to support a sign face assembly 9 having a sign face 7 in a hinged manner on the sign box 5. The sign face assembly 9 is supported by and hinged to the adapter 10 and is pivotal on the adapter between an open position, as shown in FIG. 2, and a closed position, as shown in FIG. 3. In the open position, the sign face assembly 9 is pivoted on the adapter away from the sign box so that the internal components in the sign box are accessible for servicing. In the closed position, the sign face assembly 9 is pivoted on the adapter so as to enclose and protect the internal components within the sign box.

The hinge adapter 10 has a configuration that is simple to manufacture by conventional techniques, such as by extrusion or molding. The adapter 10 can be incorporated onto existing sign boxes as well as new sign box installations. The adapter 10 comprises a generally rectangular body section 12, which as shown in FIG. 1 may be hollow. The main body section 12 is configured for attachment along the top edge 6 of the sign box 5. The hinge adapter 10 has a fulcrum that extends from the body section 12 for supporting a number of commercially available components so as to form a hinge-like connection for a sign face assembly 9.

In the embodiment of FIG. 1, the fulcrum comprises an extension arm 32 that extends from the body section 12 and connects with a side wall 37 that in turn supports an upper pivot arm or wall 38 having a face end 42 spaced away from the body section 12 to form a slotted receptacle 17 which serves as a hinge receptacle. The pivot arm 38 has a rounded terminal end 42 disposed at the mouth of a receptacle structure 39 that is configured to slidably engage and support a number of commercially available components so as to form a hinge-like connection for a sign face assembly 9.

Referring now to FIGS. 1–3, the hinge adapter 10 will be described in more detail. The adapter 10 is an elongated member that may be formed, for example, by extrusion, out of aluminum or other suitable material. Alternatively, the adapter 10 may be formed from molded plastics. The body section 12 of the adapter 10 forms a generally rectangular shaped tube that is mountable on the top face of a standard sign box 5. The body 12 has a substantially flat top wall 14 having a first end 16 and a second end 18. The body 12 also has a substantially flat bottom wall 20 generally parallel to the top wall 14. The bottom wall 20 has a first end 22 and a second end 24. A first side wall 28 is connected to the first end 16 of the top wall 14 and extends toward the bottom wall 20 where it connects with the first end 22 of the bottom wall. A second side wall 30 is connected to the second end 18 of the top wall 14 and extends toward the bottom wall 20 where it connects with the second end 24 of the bottom wall. The top wall 14, bottom wall 20, first side wall 28 and second side wall 30 combine to generally form a hollow rectangular shaped body section 12.

The body section 12 may be connected to the sign box 5 using any appropriate mounting method. In FIG. 1, the body section 12 is shown mounted to a sign box 5 using a screw 44. A pair of aligned bores 46 are formed in the body section 12 for enabling the adapter 10 to be mounted on the sign box 5. More specifically, the top wall 14 and bottom wall 20 have bores 46 that are centrally located between the first and second sidewalls 28, 30 and are axially aligned relative to one another. The bores 46 are configured to align axially with a threaded bore on the sign box 5 to allow the screw 44 to attach the body section 12 to the sign box. Preferably, the bores 46 have diameters that are slightly larger than the maximum outside diameter of the threading on the screw 44. In this way, the bores 46 allow adequate clearance of the screw 44 while limiting the potential for movement of the adapter 10 on the sign box 5 if the screw becomes loose.

The receptacle 39 is attached to one side of the main body 12 to provide the hinge receptacle. The receptacle 39 may be integrally formed with the main body 12, for example, as a single extrusion, or may be separately attached or secured to the main body 12. The receptacle 39 includes an extension arm or wall 32 which is a generally flat wall having a first end 34 and second end 36. The second end 36 of the extension arm 32 is connected to the first end 22 of the bottom wall 20. As such, the extension arm 32 forms a generally continuous surface with the bottom wall 20. The pivot arm 38 is also generally flat and extends generally parallel to the extension arm 32. The pivot arm 38 has a first end 40 and a rounded second end 42 that extends toward the body section 12, as shown in FIG. 1. A gap 43 is formed between the rounded end 42 of the pivot arm 38 and the first side wall 28 on the body section 12 to provide an access slot to the slotted receptacle 17. A third side wall 37 is connected to the first end 40 of the pivot arm 38 and extends toward the extension arm 32 where it connects with the first end 34 of the extension arm to form an elongated slotted box-like structure which serves as the slotted receptacle 17. The third side wall 37 may be shorter than side walls 28 and 30 to account for the thickness of a mating hinge connector 51 of the sign face assembly 9.

As stated earlier, the hinge adapter 10 is configured to attach a sign face assembly 9 to a sign box 5. The rounded second end 42 of the pivot arm 38 is configured to pivotally support a sign face assembly 9 to permit the face to be opened and closed on the sign box 5. More specifically, the rounded second end 42 is configured to slidably engage a curved hinge connector element 51 on a separate mounting assembly for the sign face 7 to permit the connector element 51 to pivot about the rounded second end 42 of the adapter. The hinge adapter 10 is compatible with a variety of mounting components having different geometries. Therefore, the hinge adaptor 10 is intended as a universal adapter for use in a variety of hinged sign face assemblies.

Referring to FIGS. 2–3, the adapter 10 is shown as part of a hinge assembly generally designated as 8. The adapter 10 pivotally engages with the hinge connector 51 of a sign support component 50 of the sign face assembly 9 in a hinge-like manner. The sign support component 50 serves as a mounting bracket for holding the sign face 7 in a hinged interrelationship with the sign box 5. The sign face assembly 9 may be used to support either a flexible sign face material or a rigid sign face material. In FIGS. 2–3, the sign face assembly 9 is shown pivotally supporting a flexible sign face 7. The hinge connector 51 may, as shown in FIG. 2, be provided as an integral part of the sign support 50. The sign support 50 includes a first channel 66 in which the flexible sign face 7 is anchored using a staple 70 and a flexible insert 72 pressed into the channel over the sign face material. The sign support 50 also includes a second channel 74 configured to connect with a backset brace 76 to provide strength and rigidity in the sign box 5. Details regarding the construction of the flexible sign face 7 and backset brace 76 may be found in U.S. Pat. No. 6,112,444, the contents of which are incorporated herein by reference.

The sign support bracket 50 has a generally flat top wall 52 having a first end 54, a second end 56 and a middle section 58. A first sidewall 60 extends from the middle section 58 on the top wall 52 in a direction generally perpendicular to the orientation of the top wall. A short second sidewall or tongue 62 extends from the second end 56 of the top wall in a direction generally parallel to the first side wall 60 so as to form an "L" shaped projection which serves as the hinge connector element 51. The top wall 52 connects with the second side wall 62 to form an interface hook 64 that engages the second end of the pivot arm 38.

The interface hook 64 may be rounded, as shown in FIG. 2, to generally conform to the radius of curvature of the second end 42 of the pivot arm 38. The inner curvature of the "L" shaped projection slidably pivots on the second end 42 of the pivot arm 38. As such, the support bracket 50 is configured to pivot relative to the second end of the pivot arm.

The hinge connector 51 is configured for pivoting between a closed position and an open position. In the closed position, the top wall 52 of the support bracket 50 rests on top of the pivot arm 38 such that the top wall 52 is generally parallel to and supported by the pivot arm and such that the first side wall 60 of the support bracket 50 rests against and is supported by wall 37 of the adapter, as shown on FIG. 3. In the open position, the top wall 52 of the support bracket 50 is rotated such that the top wall 52 is pivotally spaced away from and disposed at an acute angle relative to pivot arm 38, as shown in FIG. 2. The hinge connector 51 is operable to pivot the flexible sign face 7 and backset brace 76 such that the interior components of the sign box can be accessed. More specifically, the hinge connector 51 is operable to move the sign face 7 and backset brace 76 so that the fluorescent light bulbs and other interior components in the sign box are accessible for servicing. The flexible sign face 7 is pivoted about its top edge on the sign box. The bottom edge of the sign face 7 may be releasably connected to the sign box using a hasp or other latching device that releases to allow the sign face to be opened and then pivoted open about its top edge.

Thus far, the hinge assembly 8 has been described with reference to a single hinge adapter 10 mounted on a sign box. However, the hinge assembly 8 may utilize one or more hinge adapters 10 to attach a sign face assembly to a sign box. A single hinge adapter 10 may span the entire width of a sign box or span a portion of the sign box width. Alternatively, the hinge assembly 8 may utilize a plurality of short adapters that are mounted in series along the width of a sign box 5. Where a plurality of adapters 10 are used, the adapters are mounted such that the rounded ends 42 of each pivot arm 38 are substantially aligned with one another.

As stated earlier, the hinge connector 51 is pivoted on the rounded second end of the pivot arm 38 to move the sign face assembly 9 to the open position. When the hinge connector 51 is pivoted beyond a certain threshold angle relative to the pivot arm 38, the sign face assembly 9 may succumb to gravitational forces and disengage from the pivot arm. That is, the inner curvature of the "L" shaped projection of hinge connector 51 may slide out of engagement with the second end 42 of the pivot arm 38 under the weight of the sign face assembly 9. At such time, the top wall 52 of the hinge connector 51 may slip through the gap 43, rendering the hinge connection inoperable until the hinge connector is reset on the pivot arm. Such disengagement may be desirable in certain applications in order to permit the removal of the sign face assembly 9 from the adapter 10. However, in applications where the sign face assembly 9 is not intended to be removed, it may be desirable to limit the angular rotation of the hinge connector 51 so that it cannot be pivoted beyond the threshold angle.

Figure 4:
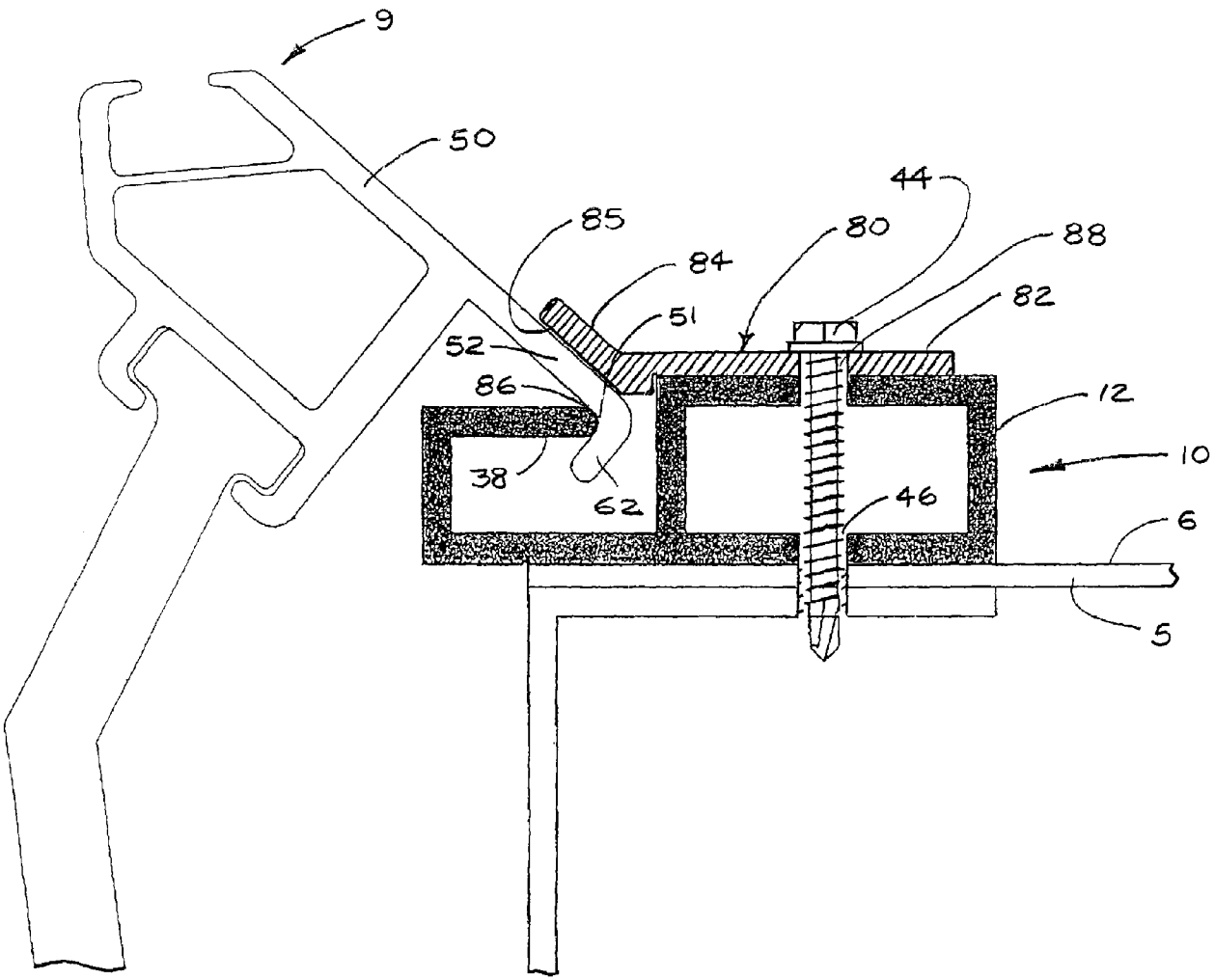
FIG. 4 is a fragmented cross-sectional elevation view of the hinge adapter of FIG. 1 mounted with a pivot stop mechanism that engages the hinge connector of the sign face assembly.

Referring now to FIG. 4, the hinged sign face assembly is shown with a pivot stop 80 attached to the hinge adapter 10. The pivot stop 80 is configured to limit the angular rotation of the hinge connector 51 relative to the adapter 10 and maintain the hinge connector 51 in pivotal engagement with the pivot arm 38. The pivot stop 80 comprises a substantially flat base 82 and a cantilever arm 84 extending from the base. The base 82 is configured for mounting on top of the body 12 of the hinge adapter 10. The cantilever arm 84 extends from the base and over the pivot arm 38. More specifically, the cantilever arm 84 projects from the base 82 outwardly and upwardly relative to the base, extending at an acute angle relative to the pivot arm 38. The cantilever arm 84 has a bottom surface 85 that is configured and positioned to contact the top wall 52 of the hinge connector 51 when the hinge connector is pivoted to the open position. When the top wall 52 of the hinge connector 51 bears against the bottom surface 85 of the cantilever arm 84, further rotation of the hinge connector is substantially prevented. As such, the angle of orientation of the cantilever arm may be selected to limit the angular displacement of the hinge connector 51. The selected angle of orientation of the cantilever arm may be a function of several variables and conditions, including but not limited to, the weight of the sign face assembly and the clearance space required when the sign face assembly is pivoted to the open position.

A pivot space 86 is formed between the pivot arm 38 and the cantilever arm 84 and is configured to permit limited angular rotation of the hinge connector 51. Preferably, the hinge connector 51 is shaped such that the top wall 52 and second side wall 62 have the same thickness. In addition, the pivot space 86 preferably has a width generally equal to the width of the top wall 52. In this way, the hinge connector 51 can pivot smoothly on the pivot arm 38 between the open and closed positions with minimal potential for sliding or disengagement from the pivot arm. The pivot stop 80 may be connected to the adapter 10 using any appropriate mounting method. In FIG. 5, the pivot stop 80 is shown mounted with the same screw 44 used to secure the adapter 10 to the sign box 5. The pivot stop 80 has a bore 88 that is configured to receive the screw 44 and align coaxially with the bores 46 in the adapter 10.

The terms and expressions which have been employed are used as terms of description and not of limitation. There is no intention in the use of such terms and expressions of excluding any equivalents of the features shown and described or any portions thereof. It is recognized, therefore, that various modifications are possible within the scope and spirit of the invention. For example, it may be desirable to have a sign face that is easily removable from the hinge adapter 10. In such case, the pivot stop 80 may be omitted, and/or the gap 43 may be widened to facilitate lifting and removal of the sign face assembly out of the hinge adapter. Accordingly, the invention incorporates variations that fall within the scope of the following claims.

I claim:

1. A hinged sign face assembly including a sign box, comprising:

(a) an adapter mountable on the sign box, comprising:

(1) a top wall having a first end and a second end;

(2) a bottom wall having a first end, a second end, and a middle section, said bottom wall extending generally parallel to the top wall;

(3) a first side wall extending from the first end of the top wall to the middle section of the bottom wall;

(4) a second side wall extending from the second end of the top wall to the second end of the bottom wall;

(5) a third side wall extending from the first end of the bottom wall, said third side wall being generally parallel to the first side wall and the second side wall; and (6) a pivot arm extending from the third side wall, said pivot arm being generally parallel to the bottom wall and having a terminal end with a rounded curvature; and (b) a sign support for a sign face mountable on the adapter in a pivotable manner, said sign support comprising:
(1) a top wall having a first end and a middle section;
(2) a first side wall extending from the middle section of the top wall in a direction generally perpendicular to the top wall; and
(3) a second sidewall extending from the first end of the top wall and forming a rounded interface with the top wall, said rounded interface having a curvature that slidably engages the curvature of the terminal end of the pivot arm to permit pivotal movement of the sign support.

2. The assembly of claim 1, wherein the sign support is pivotal on the pivot arm between a closed position, in which the top wall of the sign support contacts the pivot arm on the adapter in substantially parallel engagement, and an open position, in which the top wall of the sign support is displaced at an acute angle relative to the orientation of the pivot arm.

3. The assembly of claim 2, wherein the adapter further comprises a pivot stop extending outwardly from the adapter to engage the sign support in the open position and limit the extent to which the sign support is pivoted on the pivot arm.

4. The assembly of claim 2, wherein the first side wall of the sign support contacts the third side wall of the adapter in substantially parallel engagement when the sign support is pivoted to the closed position.

5. A hinged sign face assembly including a sign box, comprising:
(a) an adapter mountable on the sign box, comprising:
(1) a top wall having a first end and a second end;
(2) a bottom wall having a first end, a second end, and a middle section, said bottom wall extending generally parallel to the top wall;
(3) a first side wall extending from the first end of the top wall to the middle section of the bottom wall;
(4) a second side wall extending from the second end of the top wall to the second end of the bottom wall;
(5) a third side wall extending from the first end of the bottom wall, said third side wall being generally parallel to the first side wall and the second side wall; and
(6) a pivot arm extending from the third side wall, said pivot arm being generally parallel to the bottom wall and having a terminal end with a rounded curvature;
(b) a sign support pivotally mountable on the adapter, said sign support comprising:
(1) a top wall having a first end and a middle section;
(2) a first side wall extending from the middle section of the top wall in a direction generally perpendicular to the top wall; and
(3) a second sidewall extending from the first end of the top wall and forming a rounded interface with the top wall, said rounded interface having a curvature that slidably engages the curvature of the terminal end of the pivot arm to permit pivotal movement of the sign support; and
(c) a sign face mountable to the sign support.

6. The assembly of claim 5, wherein the sign support comprises a channel adjacent to the top wall of the sign support, and the sign face comprises a flexible sign material that is secured within the channel by an anchor.

7. The assembly of claim 6, wherein the anchor comprises a flexible insert configured for removable insertion into the channel over the flexible material of the sign face.

8. The assembly of claim 5, wherein the sign support is pivotal on the pivot arm between a closed position, in which the top wall of the sign support contacts the pivot arm on the adapter in substantially parallel engagement, and an open position, in which the top wall of the sign support is displaced at an acute angle relative to the orientation of the pivot arm.

9. The assembly of claim 8, wherein the adapter further comprises a pivot stop extending outwardly from the adapter to engage the sign support in the open position and limit the extent to which the sign support is pivoted on the pivot arm.

10. The assembly of claim 8, wherein the first side wall of the sign support contacts the third side wall of the adapter in substantially parallel engagement when the sign support is pivoted to the closed position.

11. An adapter for retrofitting a sign face assembly to an existing sign box in a hinge-like manner, comprising:
(a) a top wall having a first end and a second end;
(b) a bottom wall having a first end, a second end, and a middle section, said bottom wall extending generally parallel to the top wall;
(c) a first side wall extending from the first end of the top wall to the middle section of the bottom wall;
(d) a second side wall extending from the second end of the top wall to the second end of the bottom wall;
(e) a third side wall extending from the first end of the bottom wall, said third side wall being generally parallel to the first side wall and second side wall; and
(f) a pivot arm extending from the third side wall, said pivot arm being generally parallel to the bottom wall and having a terminal end with a rounded curvature.

12. The adapter of claim 11, wherein the third sidewall is shorter than the first sidewall, and shorter than the second sidewall.

13. The adapter of claim 11, wherein the pivot arm is recessed relative to the top wall.

14. The adapter of claim 11 comprising a pivot stop extending outwardly from the adapter.

15. A hinged sign face assembly including a sign box, comprising:
(a) an adapter mountable on the sign box, comprising:
(1) a top wall having a first end and a second end;
(2) a bottom wall having a first end, a second end, and a middle section, said bottom wall extending generally parallel to the top wall;
(3) a first side wall extending from the first end of the top wall to the middle section of the bottom wall;
(4) a second side wall extending from the second end of the top wall to the second end of the bottom wall; and
(5) a fulcrum extending from the first end of the bottom wall, said fulcrum having a pivot end with a rounded curvature; and
(b) a sign support for a sign face mountable on the adapter in a pivotable manner, said sign support comprising:
(1) a top wall having a first end and a middle section;
(2) a first side wall extending from the middle section of the top wall in a direction generally perpendicular to the top wall; and
(3) a second sidewall extending from the first end of the top wall and forming a rounded interface with the top wall, said rounded interface having a curvature that slidably engages the curvature of the pivot end of the fulcrum to permit pivotal movement of the sign support.

16. The assembly of claim 15, wherein the sign support is pivotal on the fulcrum between a closed position, in which the top wall of the sign support is generally parallel to the top wall of the adapter, and an open position, in which the top wall of the sign support is pivoted at an acute angle with respect to the top wall of the adapter.

17. The assembly of claim 15, wherein the adapter further comprises a pivot stop extending outwardly from the adapter to engage the sign support in the open position and limit the extent to which the sign support is pivoted on the fulcrum.

18. The assembly of claim 16, wherein the first side wall of the sign support contacts the fulcrum when the sign support is pivoted to the closed position.

19. A hinged sign face assembly including a sign box, comprising:

(a) an adapter mountable on the sign box, comprising:

(1) a top wall having a first end and a second end;

(2) a bottom wall having a first end, a second end, and a middle section, said bottom wall extending generally parallel to the top wall;

(3) a first side wall extending from the first end of the top wall to the middle section of the bottom wall;

(4) a second side wall extending from the second end of the top wall to the second end of the bottom wall; and (5) a fulcrum extending from the first end of the bottom wall, said fulcrum having a pivot end with a rounded curvature;

(b) a sign support pivotally mountable on the adapter, said sign support comprising:

(1) a top wall having a first end and a middle section;

(2) a first side wall extending from the middle section of the top wall in a direction generally perpendicular to the top wall; and (3) a second sidewall extending from the first end of the top wall and forming a rounded interface with the top wall, said rounded interface having a curvature that slidably engages the curvature of the terminal end of the fulcrum to permit pivotal movement of the sign support; and (c) a sign face mountable to the sign support.

20. The assembly of claim 19, wherein the sign support is pivotal on the fulcrum between a closed position in which the top wall of the sign support is generally parallel to the top wall of the adapter, and an open position in which the top wall of the sign support is pivoted at an angle with respect to the top wall of the adapter.

21. The assembly of claim 20, wherein the adapter further comprises a pivot stop extending outwardly from the adapter to engage the sign support in the open position and limit the extent to which the sign support is pivoted on the fulcrum.

22. The assembly of claim 20, wherein the first side wall of the sign support contacts the fulcrum when the sign support is pivoted to the closed position.

23. The assembly of claim 19, wherein the sign support comprises a channel adjacent to the top wall of the sign support, and the sign face comprises a flexible sign material that is secured within the channel by an anchor.

24. The assembly of claim 23, wherein the anchor comprises a flexible insert configured for removable insertion into the channel over the flexible material of the sign face.

25. An adapter for retrofitting a sign face assembly to an existing sign box in a hinge-like manner, comprising:

(a) a top wall having a first end and a second end;

(b) a bottom wall having a first end, a second end, and a middle section, said bottom wall extending generally parallel to the top wall;

(c) a first side wall extending from the first end of the top wall to the middle section of the bottom wall;

(d) a second side wall extending from the second end of the top wall to the second end of the bottom wall; and (e) a fulcrum extending from the first end of the bottom wall, said fulcrum having a cantilevered portion extending toward, but terminating short of, said first side wall, said cantilevered portion having a pivot end with a rounded curvature separated from the first side wall by a gap, said gap having a width less than the length of said cantilevered portion.

26. The adapter of claim 25 comprising a pivot stop extending outwardly from the adapter.

27. The adapter of claim 25 wherein the pivot end of the cantilevered portion of the fulcrum is recessed below the top wall.

* * * * *